United States Patent [19]

Kato et al.

[11] 4,388,392

[45] Jun. 14, 1983

[54] LAMINATED PHOTOSENSITIVE PLATE FOR ELECTROPHOTOGRAPHY HAVING AN ELECTRON DONATIVE POLYMER AND PHENANTHRENE CHARGE TRANSPORT LAYER

[75] Inventors: Yoshiaki Kato, Hirakata; Akira Fushida, Suita, both of Japan

[73] Assignee: Mita Industrial Co., Ltd., Osaka, Japan

[21] Appl. No.: 252,261

[22] Filed: Apr. 8, 1981

[30] Foreign Application Priority Data

Apr. 11, 1980 [JP] Japan ..... 55/46768

[51] Int. Cl.[3] ..... G03G 5/07; G03G 5/14

[52] U.S. Cl. ..... 430/58; 430/57; 430/70

[58] Field of Search ..... 430/57, 58, 59, 79

[56] References Cited

U.S. PATENT DOCUMENTS

| | | | |
|---|---|---|---|
| 3,953,207 | 4/1976 | Horgan | 430/58 |
| 4,282,298 | 8/1981 | Smith et al. | 430/58 |
| 4,302,521 | 11/1981 | Takei et al. | 430/58 |

*Primary Examiner*—John E. Kittle

*Assistant Examiner*—John L. Goodrow

*Attorney, Agent, or Firm*—Sherman & Shalloway

[57] ABSTRACT

Disclosed is a laminated photosensitive plate for electrophotography, which comprises a conductive substrate, a charge generating layer containing a photoconductive organic pigment, which is formed on the surface of the substrate, and a charge transporting layer formed on the charge generating layer, wherein the charge transporting layer is formed of a homogeneous composition comprising an electron-donative polymeric photoconductor and a fused ring-containing, electron-donative polycyclic aromatic hydrocarbon incorporated in the polymeric photoconductor in an amount of 0.05 to 3 parts by weight per part by weight of the polymeric photoconductor.

In this laminated photosensitive plate, by incorporation of the fused ring-containing, electron-donative polycyclic aromatic hydrocarbon into the charge transporting layer, not only mechanical properties such as abrasion resistance, toughness and adhesion but also electrophotographic characteristics such as initial saturation surface voltage, sensitivity and residual voltage can prominently be improved.

12 Claims, 1 Drawing Figure

LAMINATED PHOTOSENSITIVE PLATE FOR ELECTROPHOTOGRAPHY HAVING AN ELECTRON DONATIVE POLYMER AND PHENANTHRENE CHARGE TRANSPORT LAYER

BACKGROUND OF THE INVENTION (1) Field of the Invention

The present invention relates to a laminated photosensitive plate for electrophotography, which is improved in electrophotographic characteristics such as sensitivity and mechanical properties such as abrasion resistance, toughness and adhesion.

(2) Description of the Prior Art

Polyvinyl carbazole (often referred to as "PVK" hereinafter) is widely used as a polymer photoconductor having film-forming and bonding properties for the manufacture of photosensitive materials for electrophotography. However, PVK is defective in that the toughness and adhesion are insufficient. For example, PVK is brittle, readily, wears away while used for a long time and it apt to separate from a substrate in the form of slices.

As means for overcoming these defects of PVK, there is oridinarily adopted a method in which a polymeric binder such as a polyester resin, an epoxy resin or a polycarbonate resin is incorporated into PVK. However, these polymeric binders have no photoconductivity at all, and if such non-photoconductive binder is incorporated, a disadvantage of reduction of the sensitivity of the obtained photosensitive layer cannot be avoided. Furthermore, these polymeric binders are ordinarily poor in the compatibility with PVK, and therefore, a photosensitive layer comprising a blend of PVK and such polymeric binder is likely to have a heterogeneous structure and the resulting photosensitive layer is still insufficient in electrophotographic properties.

Furthermore, it has been known from old that a PVK type photoconductor can be used for manufacture of laminated photosensitive plates, and a typical instance of such known laminated photosensitive plate comprises a conductive substrate, a charge generating layer containing a photoconductive organic pigment, which is formed on the substrate, and a charge transporting layer of a PVK photoconductor formed on the charge generating layer. In this laminated photosensitive plate, however, the defect of a relatively short life of the photosensitive plate cannot be avoided because the PVK photoconductor layer is present on outermost surface layer of the photosensitive plate and the mechanical properties of this outermost surface layer of the PVK photoconductor are insufficient as pointed out hereinbefore.

SUMMARY OF THE INVENTION

We found that when a homogeneous composition comprising a fused ring-containing, electron-donative polycyclic aromatic hydrocarbon incorporated in an electron-donative polymeric photoconductor such as PVK is applied as a charge transporting layer on a charge generating layer containing a photoconductive organic pigment, mechanical properties such as abrasion resistance, toughness and adhesion are prominently improved and simultaneously, remarkable improvements of electrophotographic characteristics, such as increase of the initial saturation surface voltage, enhancement of the sensitivity and reduction of the residual voltage, can be attained. We have now completed the present invention based on this finding.

More specifically, in accordance with the present invention, there is provided a laminated photosensitive plate for electrophotography, which comprises a conductive substrate, a charge generating layer containing a photoconductive organic pigment, which is formed on the surface of the substrate, and a charge transporting layer formed on the charge generating layer, wherein the charge transporting layer is formed of a homogeneous composition comprising an electron-donative polymeric photoconductor and a fused ring-containing, electron-donative polycyclic aromatic hydrocarbon incorporated in the polymeric photoconductor in an amount of 0.05 to 3 parts by weight per part by weight of the polymeric photoconductor.

DETAILED DESCRIPTION OF THE PREFERRED EMBODIMENTS

Figure 1:
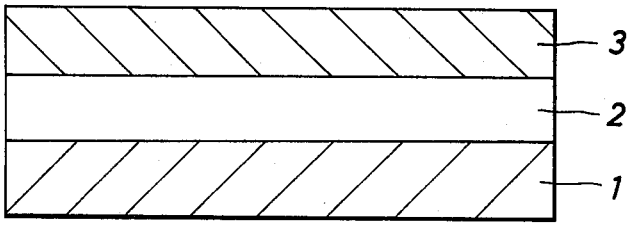
FIG. 1 is a view showing the sectional structure of the photosensitive plate according to the present invention, in which reference numerals 1, 2 and 3 represent a conductive substrate, a charge generating layer and a charge transporting layer, respectively.

Referring to FIG. 1 illustrating the sectional structure of the photosensitive plate according to the present invention, a charge generating layer 2 containing a photoconductive organic pigment is formed on the surface of a conductive substrate 1, and a charge transporting layer 3 is further formed on the charge generating layer 2. When the electrophotographic operation is carried out, the surface of the charge transporting layer 3 is negatively charged uniformly by corona discharge or the like, and imagewise exposure is then conducted. At this step, in the exposed area of the charge generating layer 2, charges, that is, paired positive holes and electrons, are generated, and the positive holes migrate through the charge transporting layer 3 to neutralize the surface negative charges and thereby form a charge image.

The most important feature of the present invention is that a homogeneous composition formed by incorporating a fused ring-containing, electron-donative polycyclic aromatic hydrocarbon into an electron-donative polymeric photoconductor is used for formation of the charge transporting layer 3. By virtue of this feature, mechanical properties and electrophotographic characteristics can prominently be improved.

In photosensitive plates for electrophotography, in order to form images having a high density, it is ordinarily required that the initial voltage should be high, and in order to increase the number of obtained prints per unit time, it is required that the sensitivity should be high, that is, the half-value exposure quantity should be small. Furthermore, in order to reduce fogging at the time of repeated reproduction, it is required that the residual voltage should be low. It is ordinarily very difficult to simultaneously satisfy all of these three requirements. More specifically, in a photosensitive plate having a high initial voltage, the residual voltage is ordinarily high, and in a photosensitive plate having a high sensitivity, the initial voltage is ordinarily low.

In contrast, when a homogeneous composition of an electron-donative polymeric photoconductor such as PVK and an electron-donative polycyclic aromatic hydrocarbon is used for formation of the charge transporting layer, the resulting photosensitive plate is highly improved over the photosensitive plate including a charge transporting layer in which such polycyclic aromatic hydrocarbon is not incorporated. Namely, prominent increase of the sensitivity (prominent reduction of the half-value exposure quantity), increase of the initial voltage and reduction of the residual voltage can simultaneously be attained. This fact will readily be understood from the experimental results shown in Examples given hereinafter.

Furthermore, in the present invention, mechanical properties are prominently improved by incorporation of the above-mentioned polycyclic aromatic hydrocarbon. When a photosensitive plate having a charge transporting layer of PVK is rubbed with high quality paper under a pressure of 2 Kg/cm$^2$, if rubbing is repeated only 10 times, the charge transporting layer is peeled on the entire surface and the substrate is exposed. In contrast, in case of a photosensitive plate having a charge transporting layer formed by incorporating the above-mentioned aromatic hydrocarbon into PVK according to the present invention, even if rubbing is carried out under the same conditions, peeling is not caused to occur at all or only very slight peeling occurs. Furthermore, the adhesion of the charge transporting layer is prominently improved according to the present invention. For example, when a photosensitive plate including a charge transporting layer formed of the above-mentioned conventional polyvinyl carbazole photosensitive and a binder is subjected to a peel adhesion test using a pressure-sensitive adhesive cellophane tape, the charge transporting layer is peeled substantially on the entire surface. On the other hand, it has been confirmed that in case of the photosensitive plate of the present invention, peeling does not occur at all at this peel adhesion test. As is seen from the foregoing description, according to the present invention, it is possible to improve the durability of the photosensitive plate. That is, the life of the photosensitive plate can remarkably be prolonged according to the present invention.

The reason why such prominent improvements can be attained in the photosensitive layer of the present invention has not completely been elucidated. It is, however, considered that these prominent effects may be due to the fact that the above-mentioned electron-donative polycyclic aromatic hydrocarbon exerts a plasticizing action to the polyvinyl carbazole type photoconductor in the state where both the compounds are dissolved in each other and this aromatic hydrocarbon per se is an electron-donative photoconductive substance as well as polyvinyl carbazole, and also due to the fact that the above-mentioned electron-donative polycyclic aromatic hydrocarbon reduces the ionization potential of the polymeric photoconductor to facilitate injection of charges (positive holes).

The polyvinyl carbazole type photoconductor that is used in the present invention is well-known, and there can be mentioned, for example, above-mentioned PVK, poly-N-allylcarbazole, poly-N-propenylcarbazole, poly-N-(2-p-vinylbenzoylethyl)carbazole, poly-N-acrylcarbazole, and nuclear substitution products thereof having such substituents as a nitro group, a halogen atom, a methyl group and an ethyl group. The molecular weight of the polyvinyl carbazole type photoconductor is not particularly critical, so far as it has a film-forming property.

By the term "fused ring-containing polycyclic aromatic hydrocarbon" is meant an aromatic hydrocarbon in which 3, 4 or 5 rings, preferably 3 to 4 rings, are bonded through at least 2 covalent carbon atoms and which has an electron-donative characteristic. The following compounds can be mentioned as preferred examples. Fluorene having the following formula:

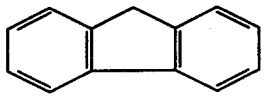

Phenanthrene having the following formula:

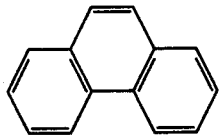

Acenaphthylene having the following formula:

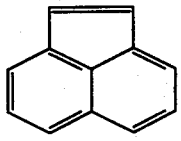

Pyrene having the following formula:

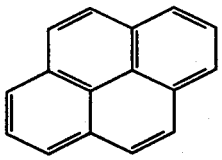

Furthermore, there can be used such aromatic compounds as perylene, dibenzophenanthrene, fluoroanthene, aceanthrene, triphenylene, chrysene and benzopyrene.

It is preferred that the fused ring-containing polycyclic aromatic hydrocarbon be present in the photosensitive layer in the state where the aromatic hydrocarbon and polyvinyl carbazole type photoconductor are dissolved in each other. From this viewpoint, it is preferred that the aromatic hydrocarbon be soluble in a solvent capable of dissolving the polyvinyl carbazole type photoconductor therein. The aromatic hydrocarbons exemplified above are very satisfactory also in this characteristic.

In the present invention, it is important that the above-mentioned fused ring-containing polycyclic aromatic hydrocarbon should be incorporated in an amount of 0.05 to 3 parts by weight, preferably 0.1 to 2 parts by weight, especially preferably 0.25 to 1.5 parts by weight, per part by weight of the polyvinyl carbazole type photoconductor. When the amount of the aromatic hydrocarbon is too small and below the above range, it becomes difficult or impossible to improve the above-mentioned mechanical properties or electrophotographic characteristics, and when the amount of the aromatic hydrocarbon is too large and exceeds the above range, electrophotographic characteristics such as the sensitivity tend to be degraded.

In the electron transporting layer that is used in the present invention, in order to further improve the electrophotographic characteristics, a Lewis acid, that is, an electron-receptive substance, may be incorporated in an amount of 0.01 to 1 part by weight per part by weight of the polymeric photoconductor. Lewis acids used for this purpose are well-known and described in detail, for example, in the specification of U.S. Pat. No. 3,287,120. We found that when a compound represented by the following formula:

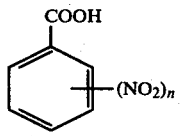

wherein n is a number of from 1 to 3, especially 2, such as 3,5-dinitrobenzoic acid, is selected among these Lewis acids and used in the present invention, especially good results are obtained because the sensitivity is further enhanced and the residual voltage is further reduced.

Furthermore, a polymeric binder having no photoconductivity, such as a polyester resin, an epoxy resin or a polycarbonate resin, may be incorporated in an amount of up to 50 parts by weight per 100 parts by weight of the polyvinyl carbazole type photoconductor according to need, though incorporation of the polymeric binder is ordinarily unnecessary.

Moreover, in order to improve the surface smoothness of the photosensitive layer, a levelling agent such as polydimethylsiloxane may be used in an amount of 0.005 to 5 parts by weight per 100 parts by weight of the PVK type photoconductor.

As the conductive substrate, there may be used a foil or plate of a metal such as aluminum, copper, tin or tin-plate in the form of a sheet or drum. Furthermore, a laminate structure formed by depositing such metal on a substrate of a film such as a biaxially stretched film or a glass substrate by vacuum evaporation, sputtering or nonelectrode plating, or a Nesa glass, may be used as the conductive substrate.

As the photoconductive organic pigment to be incorporated in the charge transporting layer, there can be mentioned, for example, a perylene type organic pigment, a bisazo pigment, a pyranthrone type pigment, a phthalocyanine pigment, a quinacridone type pigment, an indanthrene type pigment, an anthraquinone type pigment, a thioindigo type pigment and a perynone type pigment. Ordinarily, better results are obtained when there are used perylene type organic pigments such as a pigment (C.I. Pigment Red 149) of the following formula:

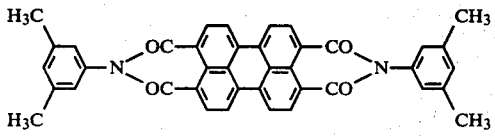

and a pigment (C.I. 71155) of the following formula:

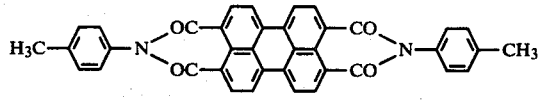

bisazo type pigments such as Dian Blue (C.I. Pigment Blue 25) and a pigment of C.I. 21200, quivacridone pigments such as a pigment of C.I. 46500, perynone type pigments such as a pigment of C.I. 71105 and a pigment of C.I. 71100, and pyranthrone type pigments such as a pigment of C.I. 59710.

Such photoconductive organic pigment may singly be applied to the conductive substrate by vacuum evaporation deposition or sputtering. In this case, the thickness of the vacuum evaporation deposition or sputtering layer is not particularly critical, but it is preferred that the thickness of this layer be 0.005 to 2 μm, especially 0.01 to 1 μm.

Furthermore, the photoconductive organic pigment may be dispersed into a binder and applied to a conductive substrate in the form of a binder-pigment composition. As the binder, there may be used a photoconductive polymeric binder, preferably a PVK type polymer such as mentioned above. Moreover, there may be used non-photoconductive resin binders, for example, acrylic resins such as polyacrylic acid esters, polymethacrylic acid esters, acrylic acid/methacrylic acid ester copolymers, acrylic acid/styrene copolymers and maleic anhydride/styrene/methacrylic acid ester copolymers, vinyl aromatic polymers such as polystyrene and polymethylstyrene, vinyl chloride resins such as vinyl chloride/vinyl acetate copolymers, saponified or partially saponified and acetalized vinyl chloride/vinyl acetate copolymers and vinyl chloride/vinyl acetate/maleic anhydride copolymers, vinyl ester polymers such as polyvinyl acetate, butadiene copolymers such as styrene/butadiene copolymers and acrylonitrile/styrene/butadiene copolymers, olefin resins such as ethylene/vinyl acetate copolymers, ethylene/acrylic acid copolymers and ionomers, polyester resins such as ethylene/butylene-terephthalate/isophthalate resins, homopolyamide and copolyamide resins, polycarbonate resins, alkyd resins, unsaturated polyester resins, urethane resins such as acrylurethane resins, epoxy resins and xylene resins. These resins may be used singly or in combination with photoconductive binders such as mentioned above.

It is preferred that the binder and the photoconductive organic pigment be combined at a weight ratio of from 1/0.2 to 1/10, especially from 1/0.5 to 1/2. Formation of a charge generating layer composed of a pigment-binder dispersion can easily be accomplished by coating a solution of the binder and pigment on a substrate. It is preferred that the thickness of this layer be 1 to 20 μm, especially 2 to 10 μm.

Formation of a charge transporting layer can easily be accomplished by forming a coating composition by dissolving the polymeric photoconductor and the aromatic hydrocarbon in an organic solvent, coating the composition on the charge generating layer formed on the conductive substrate and drying the coated composition.

As the solvent for dissolving both the PVK type photoconductor and aromatic hydrocarbon, there can be mentioned, for example, tetrahydrofuran (THF), chlorobenzene, methylene dichloride and a cyclohexane-toluene mixed solvent. An appropriate solvent is chosen and used according to the kinds of the PVK type photoconductor and aromatic hydrocarbon.

It is preferred that the thickness of the charge transporting layer be 1 to 100 μm, especially 2 to 20 μm.

The present invention will now be described in detail with reference to the following Examples that by no means limit the scope of the invention.

EXAMPLE 1

A perylene pigment (Paliogen Red 4120, C.I. 71130, supplied by BASF) was vacuum-deposited in a thickness of 0.8 μm under a pressure of $10^{-4}$ to $10^{-5}$ mmHg at a temperature of 250° to 300° C. on an aluminum vacuum-deposited polyester film having a thickness of 50 μm to form a charge generating layer.

In 160 g of tetrahydrofuran were dissolved 10 g of polyvinyl carbazole (Luvican M-170 supplied by BASF) and 1 g of a polyester resin (Adhesive 49000 supplied by Du Pont), and 5 g of phenanthrene was further dissolved in the solution to obtain a charge transporting layer-forming solution. This solution was coated on the above charge generating layer by a wire doctor blade and dried at 100° C. for 30 minutes to form a charge transporting layer having a thickness of 8 μm.

The charging characteristics of the so prepared photosensitive plate were determined by using an electrostatic copying paper testing apparatus, Model SP-428 manufactured and supplied by Kawaguchi Denki, according to the following procedures. The surface of the photosensitive plate was negatively charged by—6 KV corona discharge, and was then exposed to rays from a tungsten lamp so that the illuminance on the surface was 10 luxes. It was found that the initial voltage was—710 V. When the half-value exposure quantity was measured, it was found that the half-value exposure quantity was 8.0 lux.sec. The residual voltage (the surface voltage after passage of 3 seconds from the light exposure) was—22 V.

For comparison, a charge transporting layer-forming solution obtained by dissolving 10 g of polyvinyl carbazole (Luvican M-170 supplied by BASF) and 1 g of a polyester resin (Adhesive 49000 supplied by Du Pont) in 160 g of tetrahydrofuran was coated on the same charge generating layer as used in Example 1 by using a wire doctor blade and was then dried at 100° C. for 30 minutes to form a charge transporting layer having a thickness of 8 μm. The charging characteristics of the photosensitive plate were determined according to the same method as described in Example 1. It was found that the initial voltage was—630 V, the half-value exposure quantity was 14.0 lux.sec and the residual voltage was—45 V.

From the foregoing results, it is seen that in a photosensitive plate including a charge transporting layer comprising phenanthrene incorporated therein, the sensitization efficiency is enhanced over that of a photosensitive plate having a charge transporting layer free of phenanthrene and also the initial voltage is elevated. Furthermore, in this photosensitive plate, the residual voltage is reduced and a surface strength is increased to a high level. Thus, it has been confirmed that a laminated photosensitive plate for electrophotography which can practically be used very advantageously can be provided according to the present invention.

EXAMPLE 2

A bisazo pigment (600 Blue, C.I. Pigment Blue 25, supplied by Dainichi Seika) was vacuum-deposited in a thickness of 0.5 μm under a pressure of $10^{-4}$ to $10^{-5}$ mmHg at a temperature of about 250° to about 300° C. on an aluminum vacuum-deposited polyester film having a thickness of 50 μm to form a charge generating layer.

In 160 g of tetrahydrofuran were dissolved 10 g of polyvinyl carbazole (Luvican M-170 supplied by BASF) and 1 g of a polyester resin (Vylon 200 supplied by Toyobo), and 3 g of phenanthrene and 0.1 mg of a silicone oil (KF-96 supplied by Shinetsu Kagaku Kogyo) were further dissolved in the solution to form a charge transporting layer-forming solution. The solution was coated on the above charge generating layer by a wire doctor blade and dried at 100° C. for 30 minutes to form a charge transporting layer having a thickness of 5 μm.

The charging characteristics of the so obtained photosensitive plate were determined according to the same method as described in Example 1. It was found that the initial voltage was—380 V, the half-value exposure quantity was 7.0 lux.sec and the residual voltage was—20 V.

For comparison, a charge transporting layer-forming solution obtained by dissolving 10 g of polyvinyl carbazole (Luvican M-170 supplied by BASF) and 1 g of a polyester resin (Vylon 200 supplied by Toyobo) in 160 g of tetrahydrofuran and adding 0.1 mg of a silicon oil (KF-96 supplied by Shinetsu Kagaku Kogyo) to the solution was coated on the same charge generating layer as used in Example 2 by a wire doctor blade and was then dried at 100° C. for 30 minutes to form a charge transporting layer having a thickness of 5 μm.

The charging characteristics of the so obtained photosensitive plate were determined according to the same method as described in Example 1. It was found that the initial voltage was—360 V, the half-value exposure quantity was 11.5 lux.sec and the residual voltage was—60 V.

From the foregoing results, it will readily be understood that by incorporating phenanthrene into the charge transporting layer of the photosensitive plate according to the present invention, the sensitization efficiency can be enhanced over that of the charge transporting layer free of phenanthrene and also the initial voltage can be increased. Furthermore, the residual voltage is reduced and the surface strength is increased. Thus, it has been confirmed that a laminated photosensitive plate for electrophotography which can practically be used very advantageously can be provided according to the present invention.

EXAMPLE 3

A perylene pigment (Permanent Red BL, Pigment Red 149, supplied by Hoechst) was vacuum-deposited in a thickness of 0.5 μm under a pressure of $10^{-4}$ to $10^{-5}$ mmHg at a temperature of about 250° to about 300° C. on an aluminum vacuum-deposited polyester film having a thickness of 50 μm to form a charge generating layer.

In 160 g of tetrahydrofuran were dissolved 10 g of polyvinyl carbazole (Luvican M-170 supplied by BASF) and 2 g of a polyester resin (Vylon 200 supplied by Toyobo), and 6 g of pyrene was further dissolved in the solution to form a charge transporting layer-forming solution. The solution was coated on the above charge generating layer by a wire doctor blade and dried at 100° C. for 30 minutes to form a charge transporting layer having a thickness of 8 μm.

The charging characteristics of the so obtained photosensitive plate were determined according to the same method as described in Example 1. It was found that the initial voltage was—710 V, the half-value exposure quantity was 10.5 lux.sec and the residual voltage was—35 V.

For comparison, a charge transporting layer-forming solution obtained by dissolving 10 g of polyvinyl carbazole (Luvican M-170 supplied by BASF) and 2 g of a polyester resin (Vylon 200 supplied by Toyobo) in 175 g of tetrahydrofuran was coated on the same charge generating layer as used in Example 3 by a wire doctor blade and was then dried at 100° C. for 30 minutes to form a charge transporting layer having a thickness of 8 μm.

The charging characteristics of the so obtained photosensitive plate were determined according to the same method as described in Example 1. It was found that the initial voltage was—625 V, the half-value exposure quantity was 18.0 lux.sec and the residual voltage was—70 V.

From the foregoing results, it will readily be understood that by incorporating pyrene into the charge transporting layer of the photosensitive plate according to the present invention, the sensitization efficiency can be enhanced over that of the charge transporting layer free of pyrene and also the initial voltage can be increased. Furthermore, the residual voltage is reduced and the surface strength is increased. Thus, it has been confirmed that a laminated photosensitive plate for electrophotography which can practically be used very advantageously can be provided according to the present invention.

EXAMPLE 4

A quinacridone pigment (C.I. 46500, supplied by Dainichi Seika) was vacuum-deposited in a thickness of 0.7 μm under a pressure of $10^{-4}$ to $10^{-5}$ mmHg at a temperature of about 250° to about 300° C. on an aluminum vacuum-deposited polyester film having a thickness of 50 μm to form a charge generating layer.

In 160 g of tetrahydrofuran were dissolved 10 g of polyvinyl carbazole (Luvican M-170 supplied by BASF) and 1 g of a polyester resin (Adhesive 49000 supplied by Du Pont), and 5 g of acenaphthylene was further dissolved in the solution to form a charge transporting layer-forming solution. The solution was coated on the above charge generating layer by a wire doctor blade and dried at 100° C. for 30 minutes to form a charge transporting layer having a thickness of 5 μm.

The charging characteristics of the so obtained photosensitive plate were determined according to the same method as described in Example 1. It was found that the initial voltage was—420 V, the half-value exposure quantity was 12.5 lux.sec and the residual voltage was —30 V.

For comparison, a charge transporting layer-forming solution obtained by dissolving 10 g of polyvinyl carbazole (Luvican M-170 supplied by BASF) and 1 g of a polyester resin (Adhesive 49000 supplied by Du Pont) in 160 g of tetrahydrofuran was coated on the same charge generating layer as used in Example 4 by a wire doctor blade and was then dried at 100° C. for 30 minutes to form a charge transporting layer having a thickness of 5 μm.

The charging characteristics of the so obtained photosensitive plate were determined according to the same method as described in Example 1. It was found that the initial voltage was—350 V, the half-value exposure quantity was 23.0 lux.sec and the residual voltage was—65 V.

From the foregoing results, it will readily be understood that by incorporating acenaphthylene into the charge transporting layer of the photosensitive plate according to the present invention, the sensitization efficiency can be enhanced over that of the charge transporting layer free of acenaphthylene and also the initial voltage can be increased. Furthermore, the residual voltage is reduced and the surface strength is increased. Thus, it has been confirmed that a laminated photosensitive plate for electrophotography which can practically be used very advantageously can be provided according to the present invention.

EXAMPLE 5

A perynone pigment (Hostaperm Orange GR, C.I. 71105, supplied by Hoechst) was vacuum-deposited in a thickness of 0.7 μm under a pressure of $10^{-4}$ to $10^{-5}$ mmHg at a temperature of about 250° to about 300° C. on an aluminum vacuum-deposited polyester film having a thickness of 50 μm to form a charge generating layer.

In 175 g of tetrahydrofuran were dissolved 10 g of polyvinyl carbazole (Luvican M-170 supplied by BASF) and 2 g of a polyester resin (Vylon 200 supplied by Toyobo), and 4 g of acenaphthylene was further dissolved in the solution to form a charge transporting layer-forming solution. The solution was coated on the above charge generating layer by a wire doctor blade and dried at 100° C. for 30 minutes to form a charge transporting layer having a thickness of 6 μm.

The charging characteristics of the so obtained photosensitive plate were determined according to the same method as described in Example 1. It was found that the initial voltage was—620 V, the half-value exposure quantity was 10.5 lux.sec and the residual voltage was—25 V.

For comparison, a charge transporting layer-forming solution obtained by dissolving 10 g of polyvinyl carbazole (Luvican M-170 supplied by BASF) and 2 g of a polyester resin (Vylon 200 supplied by Toyobo) in 175 g of tetrahydrofuran was coated on the same charge generating layer as used in Example 5 by a wire doctor blade and was then dried at 100° C. for 30 minutes to form a charge transporting layer having a thickness of 6 μm.

The charging characteristics of the so obtained photosensitive plate were determined according to the same method as described in Example 1. It was found that the initial voltage was—500 V, the half-value exposure quantity was 22.0 lux.sec and the residual voltage was—110 V.

From the foregoing results, it will readily be understood that by incorporating acenaphthylene into the charge transporting layer of the photosensitive plate according to the present invention, the sensitization efficiency can be enhanced over that of the charge transporting layer free of acenaphthylene and also the initial voltage can be increased. Furthermore, the residual voltage is reduced and the surface strength is increased. Thus, it has been confirmed that a laminated photosensitive plate for electrophotography which can practically be used very advantageously can be provided according to the present invention.

EXAMPLE 6

A perylene pigment (Paliogen Red 4120, C.I. 71130, supplied by BASF) was vacuum-deposited in a thickness of 0.8 μm under a pressure of $10^{-4}$ to $10^{-5}$ mmHg at a temperature of about 250° to about 300° C. on an aluminum vacuum-deposited polyester film having a thickness of 50 μm to form a charge generating layer.

In 160 g of tetrahydrofuran were dissolved 10 g of polyvinyl carbazole (Luvican M-170 supplied by BASF) and 1 g of a polyester resin (Adhesive 49000 supplied by Du Pont), and 5 g of phenanthrene and 0.5 g of 3,5-dinitrobenzoic acid were further dissolved in the solution to form a charge transporting layer-forming solution. The solution was coated on the above charge generating layer by a wire doctor blade and dried at 150° C. for 30 minutes to form a charge transporting layer having a thickness of 10 μm.

The charging characteristics of the so obtained photosensitive plate were determined according to the same method as described in Example 1. It was found that the initial voltage was—580 V, the half-value exposure quantity was 6.5 lux.sec and the residual voltage was—3 V.

For comparison, a charge transporting layer-forming solution obtained by dissolving 10 g of polyvinyl carbazole (Luvican M-170 supplied by BASF) and 1 g of a polyester resin (Adhesive 49000 supplied by Du Pont) in 160 g of tetrahydrofuran and adding 5 g of 2,4,7-trinitro-9-fluorenone to the solution was coated on the same charge generating layer as used in Example 6 by a wire doctor blade and was then dried at 150° C. for 30 minutes to form a charge transporting layer having a thickness of 10 μm.

The charging characteristics of the so obtained photosensitive plate were determined according to the same method as described in Example 1. It was found that the initial voltage was—520 V, the half-value exposure quantity was 15.0 lux.sec and the residual voltage was—50 V.

From the foregoing results, it will readily be understood that by incorporating phenanthrene and 3,5-dinitrobenzoic acid into the charge transporting layer of the photosensitive plate according to the present invention, the sensitization efficiency can be enhanced over that of the charge transporting layer including 2,4,7-trinitro-9-fluorenone and also the initial voltage can be increased. Furthermore, the residual voltage is reduced and the surface strength is increased. Thus, it has been confirmed that a laminated photosensitive plate for electrophotography which can practically be used very advantageously can be provided according to the present invention.

EXAMPLE 7

In 15 g of tetrahydrofuran (THF) was incorporated 1 g of a perylene pigment (Permanent Red B1, C.I. Pigment Red 149, supplied by Hoechst) and the mixture was dispersed for 1 minute by an ultrasonic disperser. Then, 10 g of polyvinyl carbazole (10% THF solution of Luvican M-170 supplied by BASF) and 2 g of a polyester resin (10% THF solution of Vylon 200 supplied by Toyobo) were incorporated into the above pigment dispersion, and the mixture was dispersed for 1 minute to form a charge generating layer-forming composition. This composition was coated on an aluminum vacuum-deposited polyester film having a thickness of 50 μm by a wire doctor blade and dried at 100° C. for 20 minutes to form a charge generating layer having a thickness of 5 μm.

In 150 g of tetrahydofuran were dissolved 10 g of polyvinyl carbazole (Luvican M-170 supplied by BASF) and 8 g of phenanthrene was further dissolved in the solution to form a charge transporting layer-forming solution. The solution was coated on the above charge generating layer by a wire doctor blade and dried at 100° C. for 30 minutes to form a charge transporting layer having a thickness of 5 μm.

The charging characteristics of the so obtained photosensitive plate were determined according to the same method as described in Example 1. It was found that the initial voltage was—480 V, the half-value exposure quantity was 9.0 lux.sec and the residual voltage was—20 V.

The adhesion test was conducted by applying a pressure-sensitive adhesive cellophane tape to the photosensitive plate and abruptly peeling the tape. It was found that the photosensitive layer was not peeled and the adhesion strength was very high.

For comparison, a charge transporting layer-forming solution obtained by dissolving 10 g of polyvinyl carbazole (Luvican M-170 supplied by BASF) in 150 g of tetrahydrofuran was coated on the same charge generating layer as used in Example 7 by a wire doctor blade and was then dried at 100° C. for 30 minutes to form a charge transporting layer having a thickness of 5 μm.

The charging characteristics of the so obtained photosensitive plate were determined according to the same method as described in Example 1. It was found that the initial voltage was—470 V, the half-value exposure quantity was 13.5 lux.sec and the residual voltage was—30 V.

When the adhesion test was carried out in the same manner as described in Example 7, it was found that the photosensitive layer was exposed to such an extent that the aluminum vacuum-deposited surface of the substrate was exposed.

From the foregoing results, it will readily be understood that by incorporating phenanthrene into the charge transporting layer of the photosensitive plate according to the present invention, the sensitization efficiency can be enhanced over that of the charge transporting layer free of phenathrene and also the initial voltage can be increased. Furthermore, the residual voltage is reduced and the surface strength is increased. Thus, it has been confirmed that a laminated photosensitive plate for electrophotography which can practically be used very advantageously can be provided according to the present invention.

What we claim is:

1. A laminated photosensitive plate for electrophotography, which comprises a conductive substrate, a charge generating layer containing a photoconductive organic pigment, which is formed on the surface of the substrate, and a charge transporting layer formed on the charge generating layer, wherein the charge transporting layer is formed of a homogeneous composition comprising an electron-donative polymer photoconductor and phenanthrene incorporated in the polymeric photoconductor in an amount of 0.05 to 3 parts by weight per part by weight of the polymeric photoconductor.

2. A laminated photosensitive plate as set forth in claim 1, wherein the photoconductive organic pigment is a perylene type pigment.

3. A laminated photosensitive plate as set forth in claim 1, wherein the photoconductive organic pigment is C.I. Pigment Blue 25.

4. A laminated photosensitive plate as set forth in claim 1, wherein the photoconductive organic pigment is quinacridone.

5. A laminated photosensitive plate as set forth in any of claims 1 through 4, wherein the charge generating layer is a vacuum evaporation deposition layer of the photoconductive organic pigment.

6. A laminated photosensitive plate as set forth in claim 1, wherein the charge generating layer is formed of a composition comprising a resinous binder and the photoconductive organic pigment dispersed in the resinous binder.

7. A laminated photosensitive plate as set forth in claim 6, wherein the resinous binder is a photoconductive polymeric binder.

8. A laminated photosensitive plate as set forth in claim 6 or 7, wherein the binder and photoconductive organic pigment are present at a weight ratio of from 1/0.2 to 1/10.

9. A laminated photosensitive plate as set forth in claim 1, wherein the charge transporting layer further comprises a Lewis acid in an amount of 0.01 to 1 part by weight per part by weight of the electron-donative polymeric photoconductor.

10. A laminated photosensitive plate as set forth in claim 1, wherein the charge transporting layer further comprises a polyester resin in an amount of 0.01 to 0.5 part by weight per part by weight of the electron-donative polymeric photoconductor.

11. A laminated photosensitive plate as set forth in claim 1, wherein the electron-donative polymeric photoconductor is a polyvinyl carbazole type photoconductor.

12. The laminated photosensitive plate as set forth in claim 1 wherein the amount of phenanthrene is in the range of from 0.25 to 1.5 parts by weight, per part by weight of the polymeric photoconductor.

* * * * *